US005845706A

United States Patent [19]

Grüner et al.

[11] Patent Number: 5,845,706

[45] Date of Patent: Dec. 8, 1998

[54] HEAT EXCHANGER AND PROCESS FOR ITS MANUFACTURING

[75] Inventors: Andreas Grüner, Göppingen; Gebhard Schwarz, Stuttgart, both of Germany

[73] Assignee: Behr GmbH, Stuttgart, Germany

[21] Appl. No.: 795,323

[22] Filed: Feb. 4, 1997

[30] Foreign Application Priority Data

Feb. 14, 1996 [DE] Germany ..... 196 05 340.4

[51] Int. Cl.[6] ..... F28F 1/02; F28D 1/053

[52] U.S. Cl. ..... 165/177; 165/153; 165/167; 138/89

[58] Field of Search ..... 165/153, 170, 165/177, 167, 916, 152; 138/89; 29/890.053

[56] References Cited

U.S. PATENT DOCUMENTS

| | | | |
|---|---|---|---|
| 3,077,904 | 2/1963 | Rusche | 138/89 |
| 3,084,961 | 4/1963 | Merriman | 138/89 X |
| 4,653,581 | 3/1987 | Yogo et al. | 165/167 X |
| 4,745,967 | 5/1988 | Kern | 165/153 X |
| 4,775,006 | 10/1988 | Hesse | 165/152 X |
| 5,638,900 | 6/1997 | Lowenstein et al. | 165/153 X |

FOREIGN PATENT DOCUMENTS

| | | | |
|---|---|---|---|
| 106479 | 4/1984 | European Pat. Off. | 165/906 |
| 0444596 | 9/1991 | European Pat. Off. . | |
| 3338734 | 5/1985 | Germany . | |
| 4042019 | 7/1992 | Germany . | |
| 4414979 | 11/1995 | Germany . | |
| 4420364 | 12/1995 | Germany . | |

*Primary Examiner*—Leonard R. Leo
*Attorney, Agent, or Firm*—Evenson McKeown Edwards & Lenahan, PLLC

[57] ABSTRACT

A heat exchanger has flat tubes arranged in parallel to one another and at a distance from one another. The flat tubes are provided in the area of their ends with connection openings to adjacent flat tubes to avoid difficulties with respect to the tight closing of the open front ends, massive slide-in parts are introduced into the open tube ends. The walls of the flat tubes at least on the narrow sides against the slide-in parts. The slide-in parts therefore act as adapting pieces which determine the final form of the tubes. They cause a tight and pressure-resistant connection after the soldering.

27 Claims, 2 Drawing Sheets

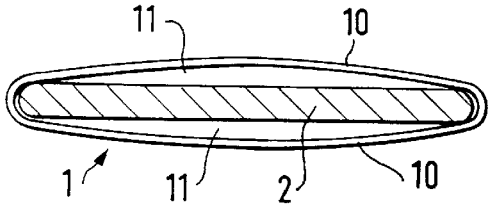
FIG. 3
FIG. 4
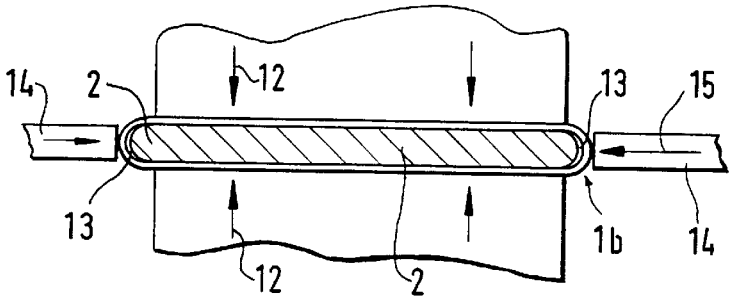
FIG. 5
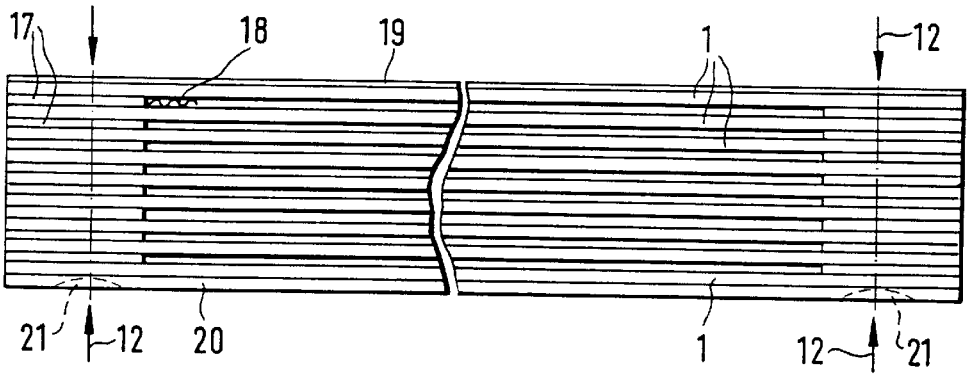
FIG. 6
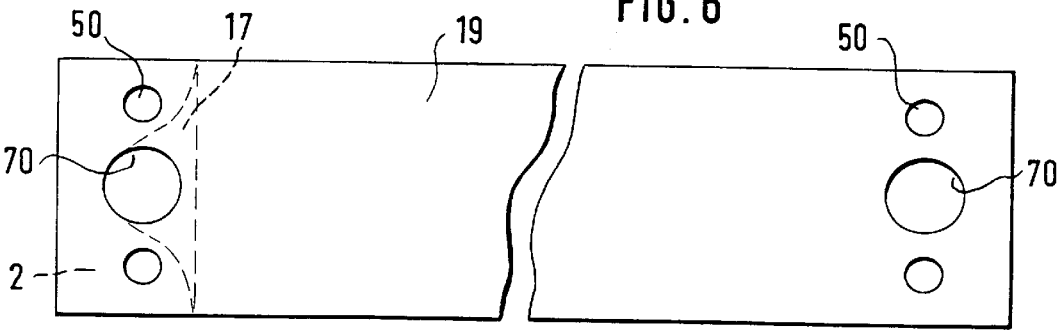

HEAT EXCHANGER AND PROCESS FOR ITS MANUFACTURING

BACKGROUND AND SUMMARY OF THE INVENTION

This invention relates to a heat exchanger having flat tubes arranged in parallel and at a distance from one another, particularly an oil cooler for motor vehicle engines, whose flat tubes are equipped in the area of their ends with connection openings to adjacent flat tubes and are closed by inserts provided on their ends. The invention also relates to a process for manufacturing such a heat exchanger.

Heat exchangers of this type are known (U.S. Pat. No. 4,745,967) which are preferably used as evaporators for vehicle air conditioners. In the case of these constructions, the flat tubes are closed on both ends by caps which are constructed in a pot-shaped manner adapted to the cross-section of the flat tubes and rest by means of their edges against the tube walls. In this case, these caps are arranged in the area outside the connection openings to the adjacent flat tubes.

It was found that, in the case of such constructions, difficulties occur in that gaps occur between the caps and the tube walls on the narrow sides which, in the case of the soldered connection, may become weak points. The gaps are caused by the tolerances and the tendency of the flat tubes to slightly bulge on their lateral walls, by means of the pressing of these lateral walls against the edges of the caps. Flat tube heat exchangers of this construction are therefore unusable particularly when higher internal pressures are to be implemented, as happens, for example, in the case of modern oil coolers of motor vehicle engines.

Although it is known (European Patent Document EP 0 444 595 B1) to seal off flat tubes in that the tube ends are folded and provided with a wave contour extending in the longitudinal direction of the fold, also such closings are not sufficiently pressure-resistant in all cases and, because of the deformation of the tube ends, may also require special measures during the assembly of several flat tubes.

It is therefore an object of the invention to develop a heat exchanger of the initially mentioned type such that, by means of simple devices, a high resistance to pressure and tightness is achieved which does not result in the risk of a deformation of the flat tubes in their end area.

For achieving this object, it is provided in the case of a heat exchanger of the initially mentioned type that the inserts are constructed as massive slide-in parts and the walls of the flat tubes are caulked against the slide-in parts at least on the narrow sides.

By means of a further development, the inserts are utilized as adapting pieces which predetermine the end shape of the flat tubes on their ends. These slide-in parts also rest with large surfaces against the interior tube walls; therefore, increase the stability of the tubes in the end area and ensure a tight and durable soldered connection. Undesired gap formations between the slide-in parts and the tube walls are excluded.

In a further development of the invention, the walls can be pressed on the narrow sides toward the interior in a wave shape. This results in a good contact of the parts pressed against one another.

As a further development of the invention, the slide-in parts may be constructed to be essentially U-shaped and may have two legs which rest against the walls of the flat tubes and whose length is larger than the distance of the connection openings from the tube end, while the indentation surrounded by the legs reaches into the area of the connection opening. This further development makes it possible that the slide-in parts exercise their supporting and shaping effect also still relatively far into the interior of the tubes. Therefore, the area of the narrow sides to be pressed on becomes larger and thus also assuring a tight soldering connection of high stability. Nevertheless, the inflow of the medium which is to be cooled or is cooling into the interior of the flat tubes is not hindered. The indentation between the legs may even have a fluidically advantageous design.

In an advantageous further development, it can be provided that the flat tubes are spaced by means of rings or disks with openings which are arranged in the area of the connection openings, in which case connections for the cooling medium or for the medium to be cooled are provided on one of the exterior flat tubes and a cover plate rests against the other exterior flat tube. Finally, this cover plate can be provided in the area of the connection openings of the flat tube resting against it with bulges which project partially into the assigned connection openings and close them. As a result, a simple construction of the heat exchanger can be provided.

For the process for manufacturing a heat exchanger of the type according to the invention, it may be provided in an advantageous further development of the invention that first the slide-in parts are introduced into the open flat tube ends and are positioned, that then the lateral walls of the flat tubes are pressed flat and are brought to rest against the walls of the slide-in parts while the narrow sides of the flat tubes are caulked toward the inside against the exterior side of the legs of the slide-in parts. As tools for the caulking of the narrow sides, pressure stamps with wavy pressure edges can advantageously be provided.

In the case of such a process, a further development of the invention permits that all flat tubes, with the insertion of the rings or disks serving as spacers, are stacked upon one another and are provided with the upper and lower cover plate; that the thus stacked parts are pressed together in the direction of the axes of the connection openings and that then caulking forces are exercised on the narrow sides of the flat tubes which extend perpendicularly to the direction of the compression forces before the thus created stack is entered into a soldering furnace. By means of such an approach, which is required anyhow for the assembling of the flat-tube heat exchanger before the soldering, as initially mentioned, the lateral walls of the flat tubes can be pressed flat from their initially curved shape and then the gap forming on the narrow sides can be eliminated by the caulking of the narrow sides of the tubes.

Other objects, advantages and novel features of the present invention will become apparent from the following detailed description of the invention when considered in conjunction with the accompanying drawings.

BRIEF DESCRIPTION OF THE DRAWINGS

FIG. 3 is a schematic representation of the starting position of the flat tube and the slide-in part in the assembled condition;

FIG. 4 is a schematic representation of the following operation for pressing the lateral walls of the flat tube flat and for caulking the narrow sides;

FIG. 5 is a schematic representation of an oil cooler constructed of flat tubes similar to the type illustrated in FIGS. 1 and 2; and FIG. 6 is a top view of the oil cooler of FIG. 5.

DETAILED DESCRIPTION OF THE DRAWINGS

Figure 1:
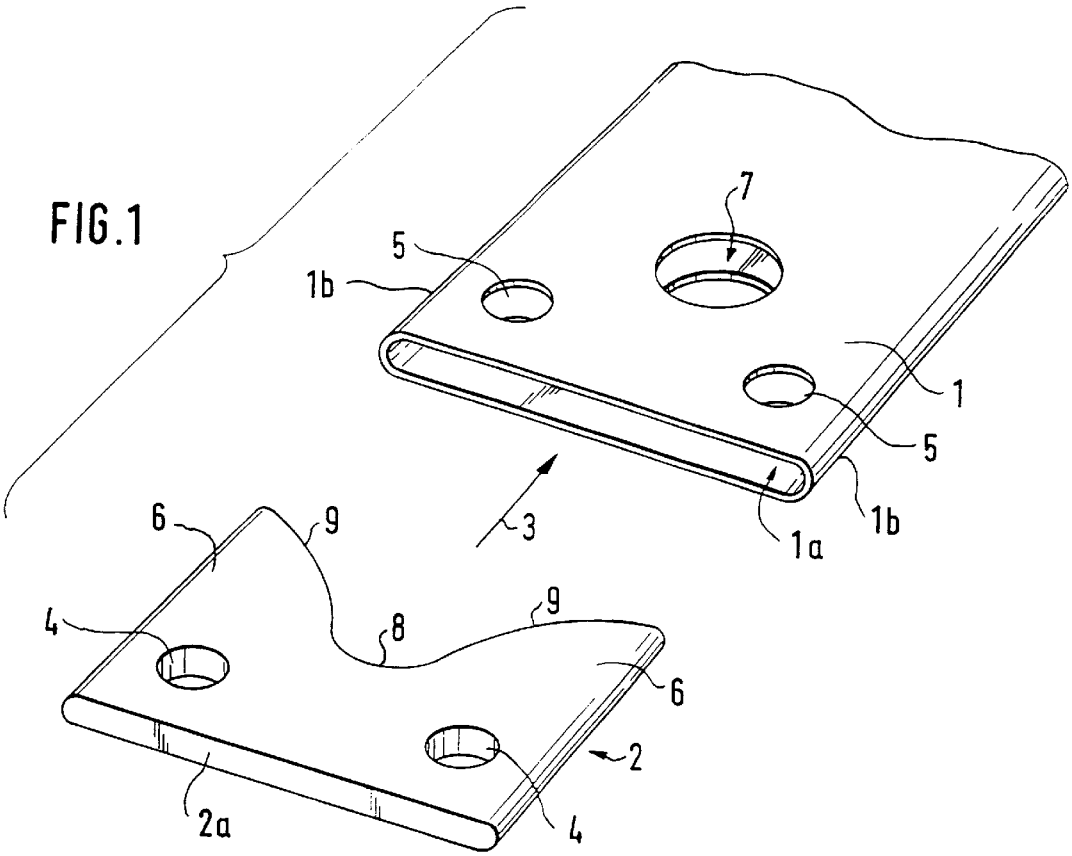
FIG. 1 is a schematic representation of the insertion operation of a slide-in part according to the invention into the open end of a flat tube.
Figure 2:
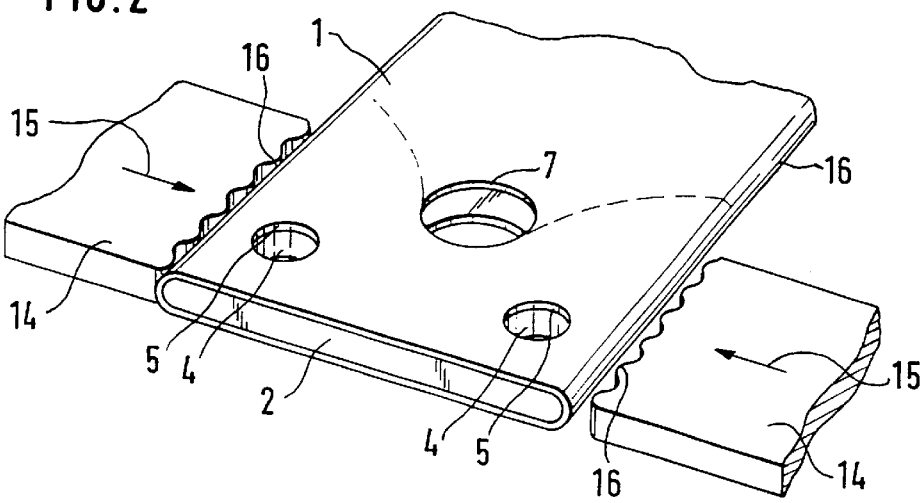
FIG. 2 is a view of the parts of FIG. 1 in the assembled and positioned condition during the caulking operation.

FIGS. 1 and 2 show an open end 1*a* of a flat tube 1 which may consist, in particular, of a correspondingly folded and welded aluminum sheet which is solder-plated in a known manner on both sides. As illustrated in FIG. 2, the open end 1*a* of the flat tube 1 is closed by means of a slide-in part 2 which is slid into the open end 1*a* in the direction of the arrow 3 until the end surface 2*a* is approximately aligned with the edge of the flat tube 1. In this position, which is also illustrated in FIG. 2, two openings 4 in the slide-in part 2 are also aligned with corresponding openings 5 in the flat tube. The slide-in part, which is constructed as a massive aluminum part, has an essentially U-shaped construction and has two exterior edges of legs 6 which, after the sliding-in, rest against the narrow sides 1*b* of the flat tube 1 and whose dimensions, like the dimensions of the remaining slide-in part 2, are adapted to the interior dimensions of the flat tube 1 such that the slide-in part 2 can easily be introduced into the open side 1*a* of the flat tube 1. In the area of its open end 1*a* and in the area of the two openings 5, the flat tube 1 has a connection opening 7 which is continuous and which, as will be explained later, permits the connection of the flat tube 1 to adjacent flat tubes which are aligned in parallel to the flat tube 1 and at a distance thereto.

The slide-in part 2 has an indentation 8 which is symmetrically framed by the two legs 6. This indentation is constructed such that, by means of its rounding, which faces the end side 2*a*, it coincides with the rounding of the connection opening 7 pointing to the open side 1*a* when the slide-in part 2 has taken up its end position according to FIG. 2. By way of lateral walls 9, the indentation 8 merges into the legs 6 which are constructed with fluid control surfaces such that the medium entering through the connection opening 7 into the flat tube 1 encounters no resistance and the formation of dead corners is also avoided. As will be explained in the following, the openings 4 and 5 are used for receiving connection elements of several flat tubes 1.

FIGS. 2, 3 and 4 show that, for establishing a tight connection between the slide-in part 2 and the flat tube 1, certain measures are to be taken. FIG. 3 illustrates in an exaggerated manner the shape of the flat tube 1, when the slide-in part 2 is slid in, in the initial position. The two lateral walls 10 of the flat tube 1 have a bulge with respect to the slide-in part which is exhibited in the formation of spaces 11 on both sides of the slide-in part 2. Since the slide-in part 2 must be soldered to the flat tube 1, according to FIG. 4, these lateral walls 10 of the flat tube 1 are therefore pressed in the direction of the arrows 12 against the plane lateral walls of the slide-in part 2. The resulting formation of gaps 13 in the area of the narrow sides 1*b* of the flat tube is prevented in that pressure stamps 14 are pressed laterally in the direction of the arrows 15 against the narrow sides 1*b* and the flat tubes 1 are therefore caulked in the area of their narrow sides against the slide-in part 2. For this purpose, the pressure stamps 14 are preferably provided with a wavy pressure edge 16 which ensures also a wave-type deformation on the narrow sides of the flat tube and thus a good contact of partial areas of the narrow sides on the legs 6 of the slide-in part 2. Gaps, which subsequently may impair the soldered connection between the flat tube 1 and the slide-in part 2, are avoided in this manner.

In an embodiment which is modified with respect to the arrangement of the connection openings 7 and the fastening openings 5 with respect to the flat tubes of FIGS. 1 and 2, FIGS. 5 and 6 show a heat exchanger according to the invention in the case of which several flat tubes 1 are stacked above one another to form a stack such that the wide sides of the flat tubes are in each case aligned in parallel to one another. In this case, the flat tubes 1 are spaced by means of disks 17 which, corresponding to the connection openings 7, are provided with openings and are correspondingly in each case positioned on the tube ends.

In a known manner, corrugated ribs 18 may also be held between the flat tubes 1, which corrugated ribs 18 will in each case fill in the gaps between the flat tubes 1 through which one of the heat exchange media flows. The thus formed flat-tube stack is closed off on the top by an upper cover plate 19 of the dimensions of the flat tubes 1 which are illustrated in FIG. 6, and is closed off on the bottom by a lower cover plate 20 which, in the case of the embodiment shown, has bulges 21 which each project from the side into the connection openings of the lower flat tube not shown in detail such that one side of the connection openings 7 is closed off tightly.

Connection pieces to the upper cover plate 19 are not shown which are fitted onto its openings 70 which, in turn, are aligned with the connection openings 7 of the flat tubes 1. The same applies to the openings 50 in the upper cover place 19 which are aligned with the openings 5 of the flat tubes 1 and the openings 4 of the slide-in parts 2 as well as with openings of the plates 17 acting as spacers, which openings are not shown. The thus constructed stack of flat tubes according to FIG. 5 can be held together by connection elements which are guided through the openings 50. In this case, the contact pressure forces can then be exercised in the direction of the arrows 12 of FIG. 4. The lateral caulking of all narrow sides of the stacked flat tubes 1 can be carried out by pressure tools of a correspondingly large construction which act in the direction of the arrows 15. The thus pretreated flat-tube stack can then be charged into the soldering furnace.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A flat tube assembly for a heat exchanger comprising:

a flat tube having an open end facing longitudinally of the tube, said flat tube having transversely extending aligned connection openings for accommodating fluid connection of the flat tube with an adjacent flat tube, and a massive solid slide-in part which in use is slid into and closing said open end, said slide-in part having longitudinally extending legs which engage narrow side walls of said tube while defining a U-shaped opening, said legs extending along and spaced from said connection openings, wherein walls of said tube are caulked against the slide-in part.

2. A flat tube assembly according to claim 1, wherein said slide-in part includes through openings for accommodating fasteners connecting the flat tube to adjacent stacked flat tubes.

3. A flat tube assembly according to claim 1, where-in said slide-in part is a solid aluminum part.

4. Heat exchanger assembly comprising:

a plurality of flat tubes, each having a pair of facing wide tube sidewalls connected by a pair of narrow tube sidewalls to form a closed tube profile with end openings at opposite ends thereof, said flat tubes being disposed adjacent one another with respect to facing parallel wide tube sidewalls, connection openings in at least one of the wide tube sidewalls of respective tubes for providing a fluid connection between adjacent ones of said tubes, and inserts closing respective end openings of the respective tubes, said inserts being constructed as solid massive slide-in parts, said slide-in parts being held by caulking of at least the narrow tube sidewalls against the slide-in parts.

5. Heat exchanger assembly according to claim 4, wherein said heat exchanger assembly forms an oil cooler for motor vehicle engines.

6. Heat exchanger assembly according to claim 4, wherein said caulking includes wavy contours pressed into said narrow tube sidewalls from outside of said tubes.

7. Heat exchanger assembly according to claim 4, wherein the slide-in parts are essentially U-shaped and have two legs which rest against the walls of the flat tubes and whose length is larger than the distance of a respective connection opening from a respective associated tube end, an indentation bounded by the legs projecting into an area adjacent the connection openings.

8. Heat exchanger assembly according to claim 7, wherein the indentation has curved fluid flow guiding lateral walls.

9. Heat exchanger assembly according to claim 8, wherein the flat tubes are spaced by means of spacers with spacer openings, said spacer openings being in an area of the connection openings when in an assembled condition, wherein two of said flat tubes are exterior flat tubes at opposite sides of the heat exchanger assembly, and wherein connections for a cooling medium are provided on one of the exterior flat tubes and a cover plate is arranged on the other exterior flat tube.

10. Heat exchanger assembly according to claim 9, wherein the cover plate is provided with bulges in an area of the connection openings of the flat tube resting against it, which bulges extend partially into assigned connection openings to close said connection openings.

11. Heat exchanger assembly according to claim 7, wherein the flat tubes are spaced by means of spacers with spacer openings, said spacer openings being in an area of the connection openings when in an assembled condition, wherein two of said flat tubes are exterior flat tubes at opposite sides of the heat exchanger assembly, and wherein connections for a cooling medium are provided on one of the exterior flat tubes and a cover plate is arranged on the other exterior flat tube.

12. Heat exchanger assembly according to claim 6, wherein the slide-in parts are essentially U-shaped and have two legs which rest against the walls of the flat tubes and whose length is larger than the distance of a respective connection opening from a respective associated tube end, an indentation bounded by the legs projecting into an area adjacent the connection openings.

13. Heat exchanger assembly according to claim 12, wherein the indentation has curved fluid flow guiding lateral walls.

14. Heat exchanger assembly according to claim 13, wherein the flat tubes are spaced by means of spacers with spacer openings, said spacer openings being in an area of the connection openings when in an assembled condition, wherein two of said flat tubes are exterior flat tubes at opposite sides of the heat exchanger assembly, and wherein connections for a cooling medium are provided on one of the exterior flat tubes and a cover plate is arranged on the other exterior flat tube.

15. Heat exchanger assembly according to claim 14, wherein the cover plate is provided with bulges in an area of the connection openings of the flat tube resting against it, which bulges extend partially into assigned connection openings to close said connection openings.

16. Heat exchanger assembly according to claim 6, wherein the flat tubes are spaced by means of spacers with spacer openings, said spacer openings being in an area of the connection openings when in an assembled condition, wherein two of said flat tubes are exterior flat tubes at opposite sides of the heat exchanger assembly, and wherein connections for a cooling medium are provided on one of the exterior flat tubes and a cover plate is arranged on the other exterior flat tube.

17. Heat exchanger assembly according to claim 16, wherein the cover plate is provided with bulges in an area of the connection openings of the flat tube resting against it, which bulges extend partially into assigned connection openings to close said connection openings.

18. Process for manufacturing a heat exchanger assembly comprising:

providing a plurality of flat tubes, each having a pair of facing wide tube sidewalls connected by a pair of narrow tube sidewalls to form a closed tube profile with end openings at opposite ends thereof, said flat tubes being disposed adjacent one another with respect to facing parallel wide tube sidewalls, providing connection openings in at least one of the wide tube sidewalls of respective tubes for providing a fluid connection between adjacent ones of said tubes, and providing inserts closing respective end openings of the respective tubes, said inserts being constructed as solid massive slide-in parts, said slide-in parts being held by caulking of at least the narrow tube sidewalls against the slide-in parts.

19. Heat process according to claim 18, wherein said heat exchanger assembly forms an oil cooler for motor vehicle engines.

20. Heat process according to claim 18, wherein said caulking includes wavy contours pressed into said narrow tube sidewalls from outside of said tubes.

21. Process according to claim 18, wherein the slide-in parts are essentially U-shaped and have two legs which rest against the walls of the flat tubes and whose length is larger than the distance of a respective connection opening from a respective associated tube end, an indentation bounded by the legs projecting into an area adjacent the connection openings.

22. Process according to claim 21, wherein the indentation has curved fluid flow guiding lateral walls.

23. Process according to claim 22, wherein the flat tubes are spaced by means of spacers with spacer openings, said spacer openings being in an area of the connection openings when in an assembled condition, wherein two of said flat tubes are exterior flat tubes at opposite sides of the heat exchanger assembly, and wherein connections for a cooling medium are provided on one of the exterior flat tubes and a cover plate is arranged on the other exterior flat tube.

24. Process according to claim 23, wherein the flat tubes are spaced by means of spacers with spacer openings, said spacer openings being in an area of the connection openings when in an assembled condition, wherein two of said flat tubes are exterior flat tubes at opposite sides of the heat exchanger assembly, and wherein connections for a cooling medium are provided on one of the exterior flat tubes and a cover plate is arranged on the other exterior flat tube.

25. Process according to claim 18, wherein said caulking includes forcing pressure stamps with corrugated pressure edges as caulking tools against the narrow side walls.

26. Process according to claim 25, comprising:

stacking all flat tubes upon one another with insertion of rings or disks used as spacers, providing upper and lower cover plates on said stacked tubes, pressing the thus stacked parts together in a direction of axes of the connection openings, and applying caulking forces on the narrow sidewalls of the flat tubes perpendicularly to the direction of the compression forces before the thus created stack is entered into a soldering furnace.

27. Process according to claim 18, comprising:

stacking all flat tubes upon one another with insertion of rings or disks used as spacers, providing upper and lower cover plates on said stacked tubes, pressing the thus stacked parts together in a direction of axes of the connection openings, and applying caulking forces on the narrow sidewalls of the flat tubes perpendicularly to the direction of the compression forces before the thus created stack is entered into a soldering furnace.

* * * * *